US009993086B2

(12) United States Patent
Harte

(10) Patent No.: US 9,993,086 B2
(45) **Date of Patent: *Jun. 12, 2018**

(54) PROSTATIC RELIEF CUSHION AND METHOD

(71) Applicant: Glenn W. Harte, Mesquite, NV (US)

(72) Inventor: Glenn W. Harte, Mesquite, NV (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/386,628

(22) Filed: Dec. 21, 2016

(65) Prior Publication Data

US 2017/0099953 A1 Apr. 13, 2017

Related U.S. Application Data

(63) Continuation-in-part of application No. 15/055,765, filed on Feb. 29, 2016, now Pat. No. 9,591,926.

(60) Provisional application No. 62/127,548, filed on Mar. 3, 2015.

(51) Int. Cl.
*A47C 7/74* (2006.01)
*A47C 7/02* (2006.01)

(52) U.S. Cl.
CPC ..... *A47C 7/744* (2013.01); *A47C 7/021* (2013.01); *A47C 7/022* (2013.01)

(58) Field of Classification Search
CPC ..... A47C 7/74; A47C 7/742; A47C 7/744; A47C 7/746; A47C 7/748
See application file for complete search history.

(56) References Cited

U.S. PATENT DOCUMENTS

| | | | |
|---|---|---|---|
| 654,720 | A | 7/1900 | Englebert |
| 859,828 | A | 7/1907 | McCloud |
| 1,568,471 | A | 1/1926 | Roemer |
| 2,260,437 | A | 10/1941 | Chambers |
| 2,853,124 | A | 9/1958 | Shapiro |
| 3,514,793 | A | 6/1970 | West |
| 4,212,692 | A | 7/1980 | Rasen et al. |
| 4,779,927 | A | 10/1988 | Trutter et al. |
| 4,923,248 | A | 5/1990 | Feher |
| 5,702,153 | A | 12/1997 | Pliska |
| 5,788,332 | A | 8/1998 | Hettinga |

(Continued)

FOREIGN PATENT DOCUMENTS

CN 101537809 A 9/2009

OTHER PUBLICATIONS

Back Be Nimble,Your One Stop Back Shop, catalog, www.backbenimble.com/prostatitis-prostate-cushion.htm.

(Continued)

*Primary Examiner* — Timothy J Brindley
(74) *Attorney, Agent, or Firm* — Arthur Jacob

(57) ABSTRACT

A cushion and method provide relief of pain or discomfort in the pelvic/genital/rectal region of a person. The person is supported on a resilient cushion construct which conforms to the person's posterior profile contour configuration, while locating a plenum-like portion of a gap beneath the pelvic/genital/rectal region of the person. An airway is extended to the gap, through a basal construct located beneath the cushion construct and an air mover moves ambient air through the airway and into the plenum-like portion of the gap to provide cooling to the pelvic/genital/rectal region of the person supported on the cushion construct.

20 Claims, 5 Drawing Sheets

(56) References Cited

U.S. PATENT DOCUMENTS

| | | | | |
|---|---|---|---|---|
| 5,924,767 | A * | 7/1999 | Pietryga | A47C 7/74 297/180.11 |
| 6,068,332 | A | 5/2000 | Faust et al. | |
| 6,523,202 | B2 | 2/2003 | Loomos | |
| 7,070,231 | B1 | 7/2006 | Wong | |
| 7,083,236 | B1 | 8/2006 | Smith | |
| 7,117,611 | B2 | 10/2006 | Park et al. | |
| 7,344,196 | B2 | 3/2008 | Rodriquez | |
| 8,127,383 | B2 | 3/2012 | Gladney et al. | |
| 8,468,628 | B1 | 6/2013 | Cheng | |
| 8,696,059 | B2 | 4/2014 | Carmichael, IV | |
| 2003/0204913 | A1 | 11/2003 | McKinney et al. | |
| 2005/0066505 | A1 | 3/2005 | Iqbal et al. | |
| 2005/0229557 | A1* | 10/2005 | Little | A47C 7/383 55/385.1 |
| 2008/0084095 | A1 | 4/2008 | Wolas | |
| 2008/0290702 | A1 | 11/2008 | Shin | |
| 2010/0295339 | A1* | 11/2010 | Siu | A47C 7/021 297/180.14 |
| 2011/0260509 | A1* | 10/2011 | Siu | A47C 7/021 297/180.14 |
| 2012/0079661 | A1 | 4/2012 | Chen | |
| 2015/0061331 | A1* | 3/2015 | Yang | A47C 7/744 297/180.14 |
| 2015/0224006 | A1 | 8/2015 | Primo et al. | |
| 2015/0239321 | A1 | 8/2015 | Muller et al. | |
| 2016/0152167 | A1 | 6/2016 | Kozlowski | |
| 2016/0286971 | A1* | 10/2016 | Pan | A47C 21/044 |

OTHER PUBLICATIONS

Support Plus, http://www.supportplus.com/cgi-bin/hazel.cgi?action=DETAIL&ITEM=FE1852.

http://www.amazon.com/ERGO-Pedic-Coccyx-Cushion-Memory-Airplane/dp/B00MP38M64/ref=sr_1_1?ie=UTF8&qid=1456756570&sr=8-1&keywords=ergo-pedic+comfort+cushion/.

* cited by examiner

PROSTATIC RELIEF CUSHION AND METHOD

This application is a continuation-in-part of U.S. patent application Ser. No. 15/055,765, filed Feb. 29, 2016, now U.S. Pat. No. 9,591,926, which application claims the benefit of U.S. Provisional Patent Application Ser. No. 62/127,548, filed Mar. 3, 2015, the entire subject matter of which is incorporated herein by reference thereto.

The present invention relates generally to the relief of pain or discomfort in the pelvic/genital/rectal regions of the human body and pertains, more specifically, to the relief of the effects of prostatism.

A wide variety of devices, usually in the form of seat cushions, have been made available for the relief of pain or discomfort arising out of disorders occurring in the pelvic area of the human body. In particular, a number of cushions currently are available which purport to relieve pain and discomfort related to prostatic disorders, while a person is seated, usually for extended periods. The present invention provides a cushion construction created to relieve pain and discomfort associated with such conditions and, in particular, symptoms connected with prostatitis. As such, the present invention attains several objects and advantages, some of which are summarized as follows: Alleviates pain and discomfort while a person is seated, arising out of disorders in the pelvic/genital/rectal regions and, in particular, in connection with the presence of prostatitis; provides a cushion construction readily employed in connection with conventional seating for the relief of prostatic pain and discomfort which otherwise might be experienced under ordinary seating arrangements; exhibits a high degree of comfort and convenience when employed in a wide variety of seating venues, including home, workplace and vehicular seating; provides a relatively simple cushion construction, economically manufactured and easily put into place for exemplary performance; offers a unique combination of structural integrity and effective performance in alleviating symptoms connected with prostatitis in a relatively simple and compact cushion construction; provides a rugged construction for reliable performance over long-term service.

The above objects and advantages, as well as further objects and advantages, are attained by the present invention, which may be described briefly as a cushion for accommodating a posterior profile contour configuration present at the pelvic/genital/rectal region of a person to provide the person with relief of pain or discomfort, the cushion comprising: a cushion construct having a resilient core for supporting the person while conforming to the posterior profile contour configuration, the cushion construct having a U-shaped plan configuration including a laterally extending rear spine and laterally spaced apart, longitudinally extending legs projecting forward from the laterally extending rear spine to corresponding remote forward terminal ends and establishing a gap between the legs, the gap extending longitudinally along the legs from the laterally extending rear spine to the corresponding remote terminal ends of the legs; and a basal construct affixed to the cushion construct, beneath the cushion construct, the basal construct including a substrate having a plan configuration corresponding to, and contiguous with, at least a portion of the U-shaped plan configuration of the cushion construct, the basal construct further including at least two airways within the substrate, each one of the two airways extending between an air inlet placed at a forward location forward of and spaced longitudinally from a corresponding remote forward terminal end of a corresponding leg, and a corresponding air outlet, the corresponding air outlet being located at an air port juxtaposed with the gap, each airway being arranged for conducting ambient air from a corresponding air inlet to a corresponding air port, and an air mover arrangement placed at the forward location for moving ambient air from the air inlet, through the airways, and out the corresponding air ports into the gap, then through the gap and out of the cushion at an exhaust outlet located between the corresponding remote terminal ends of the legs, and then longitudinally between the forward terminal ends and the forward location to provide an unobstructed exit from the cushion for facilitating a flow of continuously exchanged cooling ambient air through the gap and out of the cushion at the exhaust outlet and directing the flow of continuously exchanged cooling ambient air to the pelvic/genital/rectal region of the person supported on the cushion construct, thereby providing the person with relief of pain or discomfort.

In addition, the present invention includes a method for accommodating a posterior profile contour configuration present at the pelvic/genital/rectal region of a person to provide the person with relief of pain or discomfort, the cushion comprising: providing a cushion construct having a resilient core for supporting the person while conforming to the posterior profile contour configuration, the cushion construct having a U-shaped plan configuration including a laterally extending rear spine and laterally spaced apart, longitudinally extending legs projecting forward from the laterally extending rear spine to corresponding remote forward terminal ends and establishing a gap between the legs, the gap extending longitudinally along the legs from the laterally extending rear spine to the corresponding remote terminal ends of the legs; affixing a basal construct to the cushion construct beneath the cushion construct, the basal construct including a substrate having a plan configuration corresponding to, and contiguous with, at least a portion of the U-shaped plan configuration of the cushion construct; providing at least two airways within the substrate; extending each one of the two airways between an air inlet placed at a forward location forward of and spaced longitudinally from the forward terminal ends of the legs, and a corresponding air outlet; locating each corresponding air outlet at an air port juxtaposed with the gap; arranging each airway for conducting ambient air from a corresponding air inlet to a corresponding air port; and placing an air mover arrangement at the forward location for moving ambient air from the air inlet, through the airways, and out the corresponding air ports into the gap, then through the gap and out of the cushion at an exhaust outlet located between the corresponding remote terminal ends of the legs, and then longitudinally between the forward terminal ends and the forward location to provide an unobstructed exit from the cushion for facilitating a flow of continuously exchanged cooling ambient air through the gap and out of the cushion at the exhaust outlet and directing the flow of continuously exchanged cooling ambient air to the pelvic/genital/rectal region of the person supported on the cushion construct, thereby providing the person with relief of pain or discomfort.

The invention will be understood more fully, while still further objects and advantages will become apparent, in the following detailed description of preferred embodiments of the invention illustrated in the accompanying drawing, in which.

Figure 1:
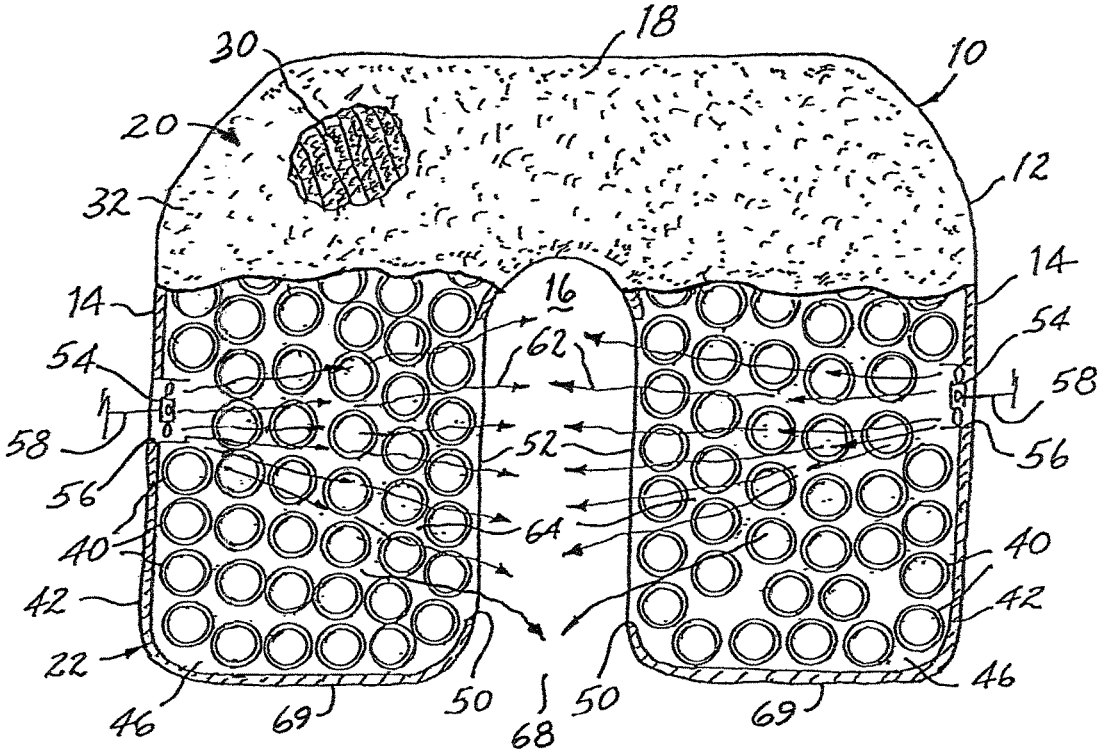
FIG. 1 is a somewhat diagrammatic, top plan view of a prostatic relief cushion constructed in accordance with the present invention, with portions broken away to reveal internal structural details.
Figure 2:
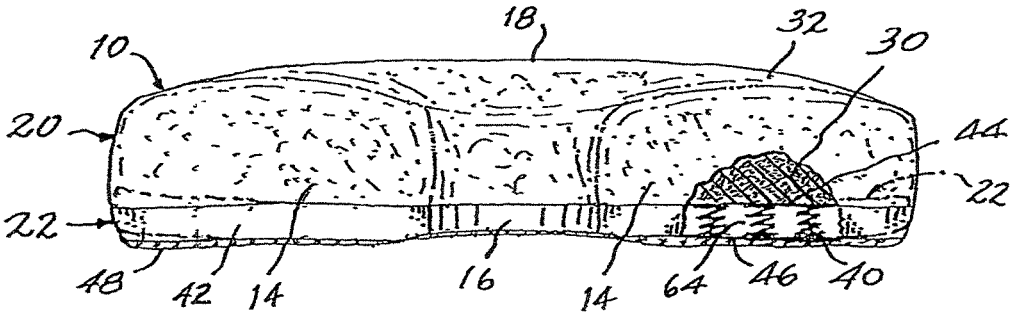
FIG. 2 is a front elevational view of the prostatic relief cushion, with portions broken away to reveal internal structural details.
Figure 3:
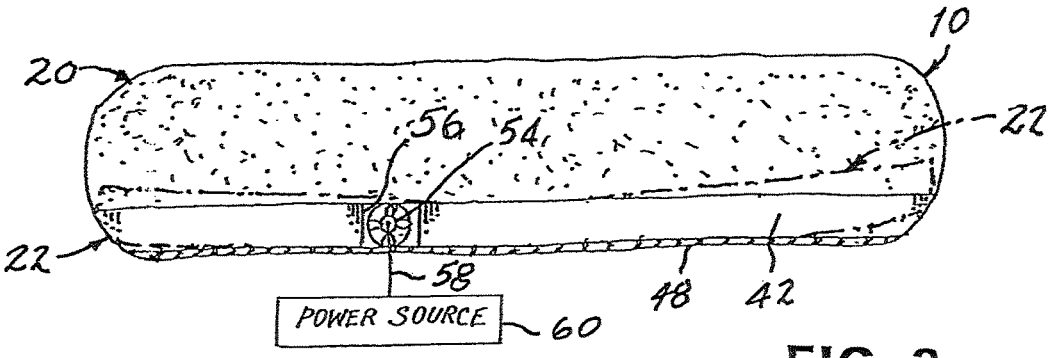
FIG. 3 is a partially diagrammatic side elevational view of the prosthetic relief cushion.

Referring now to the drawing, and especially to FIGS. 1 through 3 thereof, a prostatic relief cushion constructed in accordance with the present invention is shown at 10 and is seen to have an overall U-shaped plan configuration 1.2 including a pair of laterally spaced apart, longitudinally extending members, shown in the form of legs 14 establishing a laterally central gap 16 located between the legs 14, and an integrated, laterally extending connecting spine 18. Cushion construction 10 includes a resilient cushion construct 20 affixed to a resiliently flexible basal construct 22.

Cushion construct 20 is comprised of a core 30, preferably made up of a synthetic polymeric foam material, commonly known as a "memory foam", and a fabric cover 32 encasing the core 30. Basal construct 22 includes substrate comprised of a multiplicity of resiliently flexible elements, shown in the form of independent coil springs 40, encased within a peripheral wall 42, and extending altitudinally between upper and lower partitions 44 and 46, respectively, in a manner similar to the construction of a coil spring mattress. Cushion 10 is dimensioned for placement upon a seat (not shown) to receive a seated person (not shown), and a bottom layer 48 of a soft, conformable material, such as felt or a foamed synthetic polymeric material, is affixed to lower partition 46 to protect the seat against marring, scratching or other damage, while assisting in maintaining cushion 10 in place upon the seat.

As best seen in FIG. 1, peripheral wall 42 includes openings 50 confronting one another in juxtaposition with gap 16, at laterally opposite sides 52 of gap 16, and an air mover in the form of a small electrically-operated fan 54 is placed within an air inlet 56 in peripheral wall 42, with each fan 54 located laterally opposite a corresponding opening 50. Each fan 54 is connected, via a line 58, to a power source 60 which, in domestic and commercial venues, may be in the form of conventional AC power, or in a vehicle, may be in the form of a conventional vehicle power supply.

In use, with cushion 10 in place upon a seat, a person is seated upon cushion construct 20, with the person's prostate area juxtaposed with gap 16. Comfort is provided by the combination of resilient core 30, which conforms to the person's posterior profile contour configuration, and the multiplicity of coil springs 40, which allow some flexing of basal construct 22, as illustrated in phantom in FIGS. 2 and 3. Once the person is appropriately situated on cushion 10, with the person's posterior positioned upon legs 14 of cushion 10, fans 54 are activated to draw ambient air through air inlets 56 and direct a flow 62 of cooling air through openings 50, into gap 16 and to the person's prostate area, thus soothing and relieving any pain or discomfort being experienced by the seated person as a result of inflammation caused by prostatitis. By virtue of the open construction of coil springs 40, and the concomitant air flow permeability provided by the clear airways established by the open structure across basal construct 22, as illustrated at 64 in FIGS. 2 and 3, the flow 62 of cooling air from each air inlet 56 to a corresponding opening 50, and into gap 16, is facilitated, while the integrity and flexibility of basal construct 22, as well as of cushion construct 20, is maintained. The overall U-shaped plan configuration 12 of cushion 10 enables the flow 62 of air to be exhausted from gap 16 at exhaust outlet 68 located between the remote terminal ends 69 of the legs 14 to establish an exit from the cushion 10 so as to facilitate a continuous exchange of air within gap 16 and the concomitant continued soothing and relief provided by a fresh supply of cool air adjacent the person's pelvic/genital/rectal regions. It will be apparent that the same soothing and relief is made available by cushion 10 to persons suffering from symptoms caused by inflammation resulting from rectal maladies such as hemorrhoids, by certain genital maladies or by maladies resulting in inflammation in the pelvic area.

Figure 4:
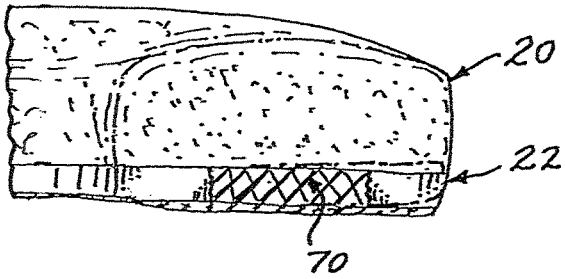
FIG. 4 is a fragmentary front elevational view similar to a portion of FIG. 2, showing an alternate construction.

Turning now to the embodiment illustrated in FIG. 4, in an alternate construction, the multiplicity of coil springs 40 illustrated in the embodiment of FIGS. 1 through 3 have been replaced by a substrate comprised of a metallic mesh 70 constructed in the manner disclosed in U.S. Pat. No. 8,127,383, the disclosure of which is incorporated herein by reference thereto. Metallic mesh 70 is provided with sufficient structural strength to withstand the weight-bearing and contour-conforming demands of a cushion, while facilitating the resilient flexibility and the air flow permeability desired in a prostatic relief cushion, as described above.

Figure 5:
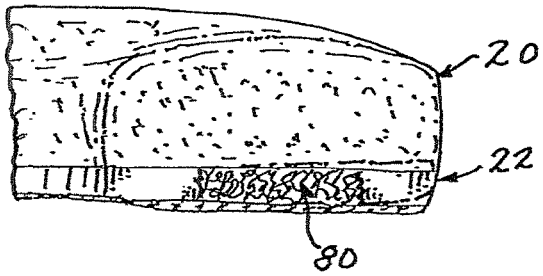
FIG. 5 is a fragmentary front elevational view similar to a portion of FIG. 2, showing another alternate construction.
Figure 6:
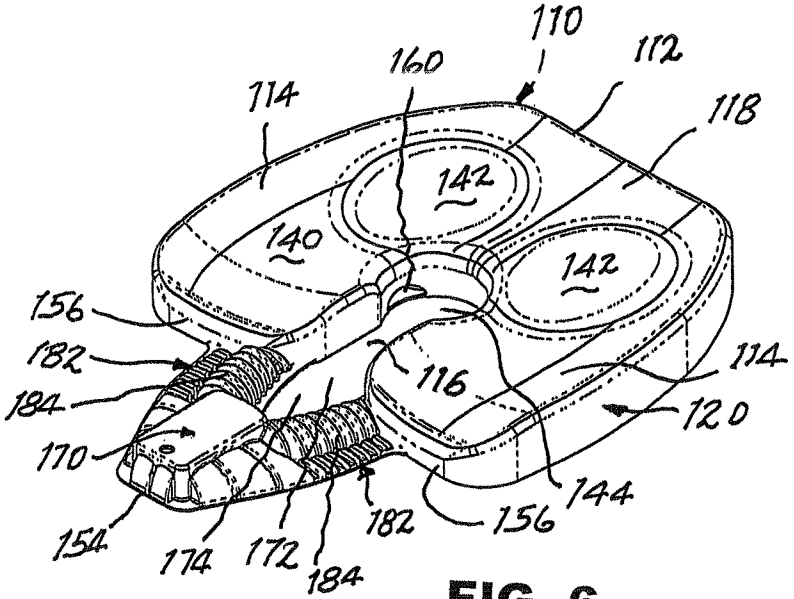
FIG. 6 is a pictorial view of another prostatic relief cushion constructed in accordance with the present invention.
Figure 8:
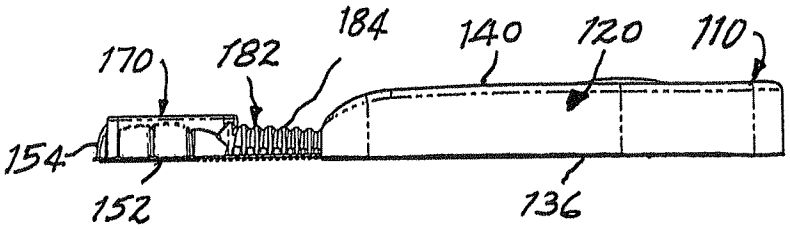
FIG. 8 is a side elevational view of the prostatic relief cushion of FIG. 6.
Figure 7:
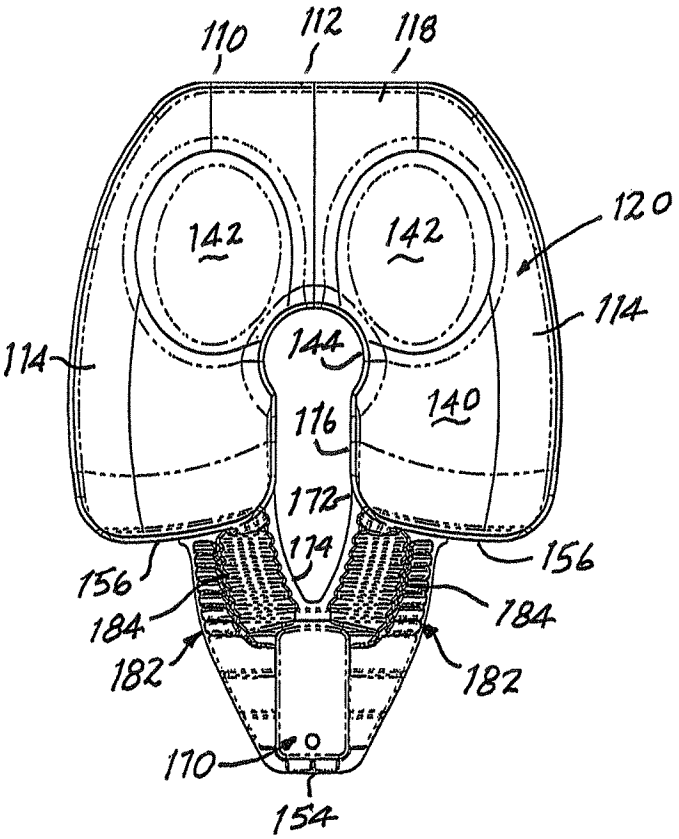
FIG. 7 is a top plan view of the prostatic relief cushion of FIG. 6.
Figure 9:
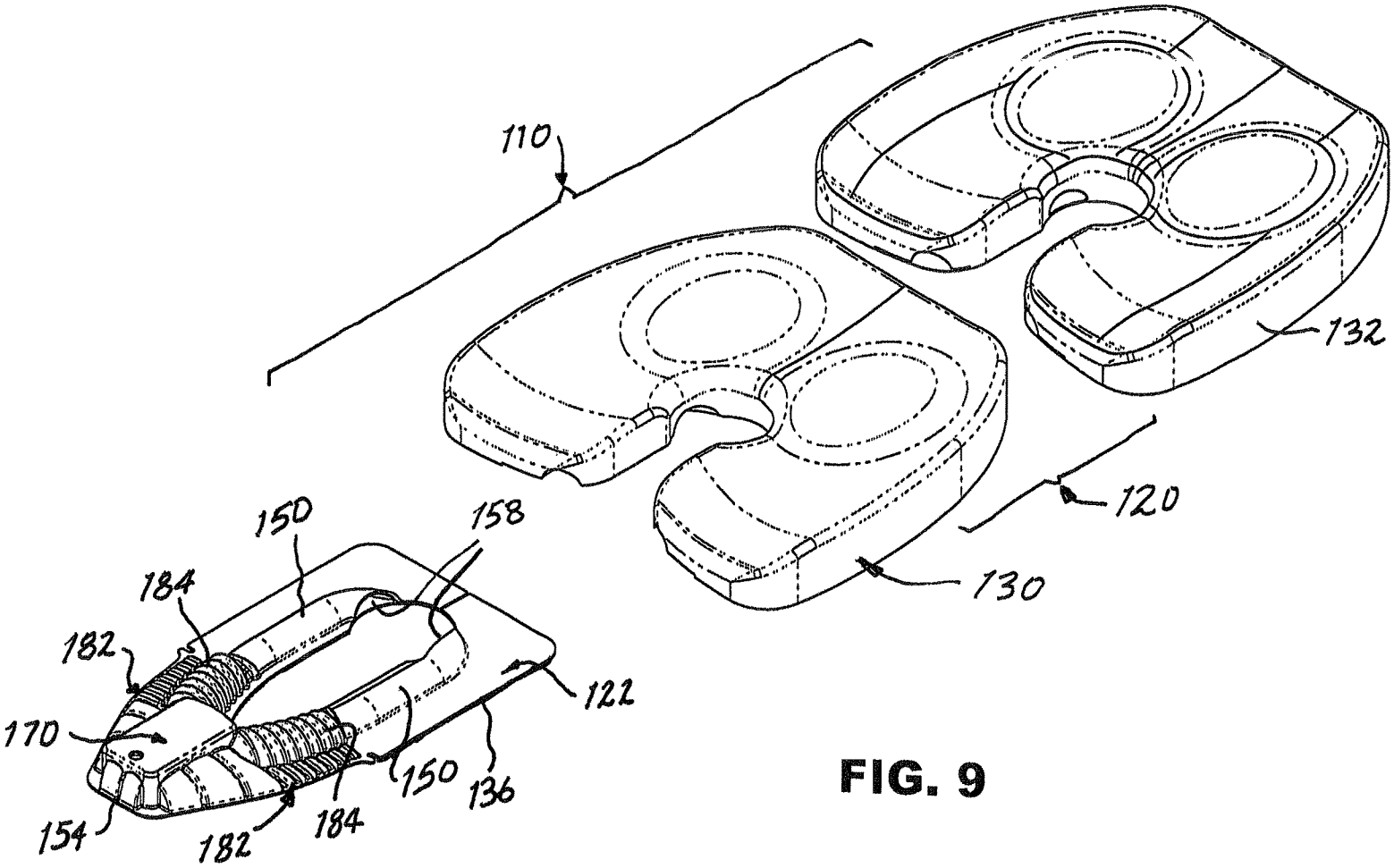
FIG. 9 is an exploded pictorial view of the prostatic relief cushion of FIG. 6.

With reference to the embodiment illustrated in FIG. 5, in another alternate construction, the multiplicity of coil springs 40 illustrated in the embodiment of FIGS. 1 through 3 have been replaced by a substrate comprised of a random mesh 80 of plastic filaments, constructed in the manner disclosed in U.S. Pat. No. 5,788,332, the disclosure of which is incorporated herein by reference thereto. Mesh 80 is provided with sufficient structural strength to withstand the weight-bearing and contour-conforming demands of a cushion, while facilitating the resilient flexibility and the air flow permeability desired in a prostatic relief cushion, as described above. Random mesh 80 may be produced economically in the form of intermingled or tangled synthetic polymeric fibers, in a manner similar to that disclosed in U.S. Pat. No. 4,212,692, the disclosure of which is incorporated herein by reference thereto.

Referring now to FIGS. 6 through 11, another prostatic relief cushion constructed in accordance with the present invention is shown at 110 and is seen to have an overall U-shaped plan configuration 112 including a pair of laterally spaced apart, longitudinally extending members, shown in the form of legs 114 establishing a laterally central gap 116 located between the legs 114, and an integrated, laterally extending connecting spine 118. Cushion 110 includes a resilient cushion construct 120 affixed to a basal construct 122. Cushion construct 120 follows the overall U-shaped plan configuration 112, while basal construct 122 includes a substrate 124 having a plan configuration at least a portion of which corresponds to, and is contiguous with, the U-shaped plan configuration of the cushion construct 120.

Cushion construct 120 is comprised of a core 130, preferably made up of a synthetic polymeric foam material, commonly known as a "memory foam," and a fabric cover 132 encasing the core 130. Basal construct 122 is comprised of an upper frame 126 and a lower base plate 128 affixed to upper frame 126. Cushion 110 is dimensioned for placement upon a seat, shown at 134 in FIG. 11 to receive a seated person (not shown), with lower base plate 128 resting securely upon seat 134. A bottom layer 136 of a soft, conformable material, such as felt or a foam synthetic polymeric material, is affixed to the underside of lower base plate 128 to protect the seat 134 against marring, scratching or other damage, while assisting in maintaining cushion 110 in place upon seat 134. Cushion construct 120 includes an upper surface 140 having an ergonomic contour configuration which includes depressions 142 for assisting a person in arriving at a comfortable and effective position when seated upon cushion 110. These depressions 142 are placed largely within spine 118, with each depression 142 located adjacent a corresponding leg 114. The depressions 142 accommodate the posterior profile contour configuration of a person and assist in positioning the person so as to register the pelvic/genital/rectal region of the person with a plenum-like portion 144 of gap 116 placed at the intersection of the legs 114 with the spine 118, plenum-like portion 144 having an essentially partial-circular configuration for purposes set forth below.

Basal construct 122 includes two airways 150 within substrate 124, each one of the two airways 150 extending between an air inlet 152 placed at a forward location 154 forward of and spaced longitudinally from remote terminal ends 156 of legs 114, and corresponding air outlets 158. Each air outlet 158 is registered with a corresponding air port 160 located in juxtaposition with gap 116, at the plenum-like portion 144 of the gap 116. Thus, each airway 150 follows a complementary air channel 162 extending through each leg 114 of cushion 110, from a remote terminal end 156 of a leg 114 to a corresponding air port 160 for conducting ambient air from air inlet 152 to an air port 160 and into gap 116 at plenum-like portion 144.

An air mover arrangement 170 is placed at the forward location 154 for moving ambient air from the air inlet 152, through the airways 150, and out the corresponding air ports 160 into the plenum-like portion 144 of the gap 116 where the cooling air establishes a pool within the plenum-like portion 144 for effective exposure of the pelvic/genital/rectal region of a seated person to a continuous exchange of soothing cool air. Then, the air is passed from the pool through the gap 116 and out of the cushion 110 at an exhaust outlet 172 located between the corresponding remote terminal ends 156 of the legs 114, and then longitudinally between the forward terminal ends 156 and the forward location 154 to provide an unobstructed exit 174 from the cushion 110 for facilitating a flow of continuously exchanged cooling ambient air into and out of the plenum-like portion 144 of gap 116, then through the gap 116 and out of the cushion 110 at the exhaust outlet 172, thereby directing the flow of continuously exchanged cooling ambient air to the pelvic/genital/rectal region of the person supported on the cushion construct 120, thus providing the person with relief of pain or discomfort.

In the preferred construction, the airways 150 provided by substrate 124 are spaced apart laterally from one another adjacent corresponding forward terminal ends 156 and then converge toward the forward location 154 to establish a clear opening that provides the unobstructed exit 174 from the cushion 110 for the flow of continuously exchanged cooling ambient air. The air mover arrangement 170 includes a single air mover, shown diagrammatically in the form of a fan 176 located at the forward location and associated with both airways 150 and corresponding air ports 160. A self-contained power source, such as a battery 178, may be operatively coupled with the fan 176 for selective operation of the fan 176.

Figure 11:
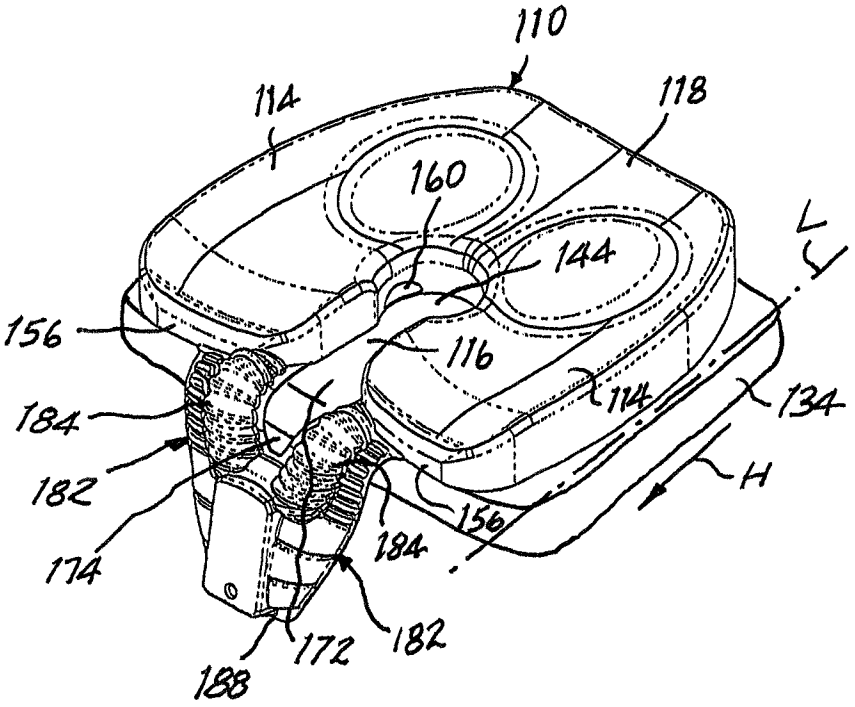
FIG. 11 is a pictorial view of the prostatic relief cushion of FIG. 6, illustrated in a different operating configuration.
Figure 10:
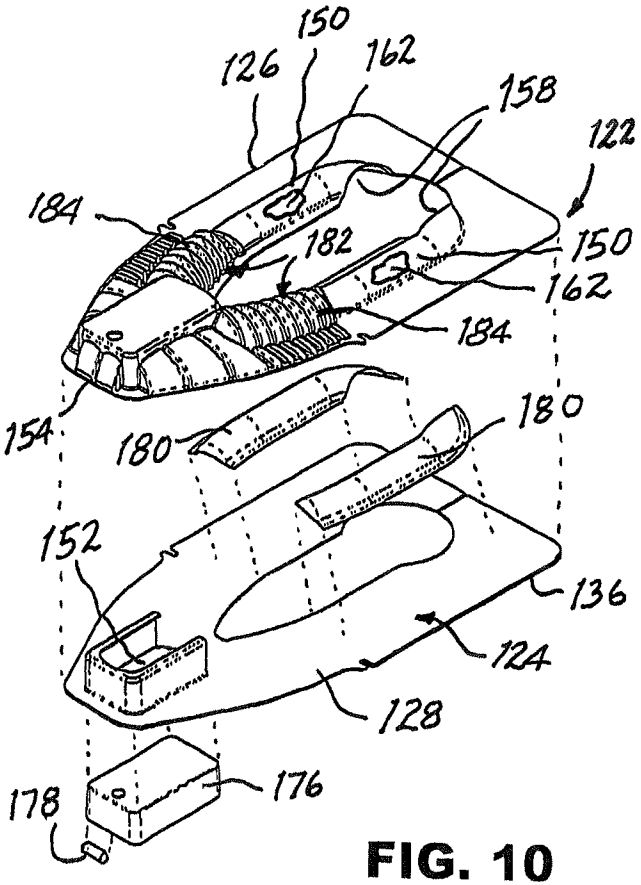
FIG. 10 is an exploded pictorial view of a component of the prostatic relief cushion of FIG. 6.

In the preferred construction, substrate 124 is constructed of a thermoformed synthetic polymeric material, such as a cross-linked olefin foam. Reinforcing liners 180 are placed within substrate 124 between the terminal end 156 of each leg 114 and a corresponding air port 160 in order to assure the maintenance of a clear, unobstructed air channel 162 within the cushion construct 120. Further, substrate 124 includes tubular constructs in the form of aims 182 which continue the airways 150 between the forward location 154 and a terminal end 156 of a corresponding leg 114 and which include corrugations 184 that render arms 182 selectively bendable. Thus, with reference to FIG. 11, with cushion 110 in place on seat 134, cushion construct 120 extends in a horizontal direction H at a given level L, between the rear connecting spine 118 and the forward terminal ends 156 of the legs 114, while arms 182 selectively are bent so as to place air inlet 152 at an air inlet location 188 spaced vertically below the given level L, as seen in FIG. 11. In this manner air inlet 152 and exhaust outlet 172 remain unobstructed when a person is seated on cushion 110. When located at air inlet location 188, the air mover arrangement 170 is placed out of the way, that is, presents no obstruction to appropriate placement and comfort of the seated person. Further, air inlet 152 confronts seat 134, thereby avoiding any potential blockage of incoming air by pant legs or upholstery and the like, while reducing fan noise.

It will be seen that the present invention attains all of the objects and advantages summarized above, namely: Alleviates pain and discomfort while a person is seated, arising out of disorders in the pelvic/genital/rectal regions and, in particular, in connection with the presence of prostatitis; provides a cushion construction readily employed in connection with conventional seating for the relief of prostatic pain and discomfort which otherwise might be experienced under ordinary seating arrangements; exhibits a high degree of comfort and convenience when employed in a wide variety of seating venues, including home, workplace and vehicular seating; provides a relatively simple cushion construction, economically manufactured and easily put into place for exemplary performance; offers a unique combination of structural integrity and effective performance in alleviating symptoms connected with prostatitis in a relatively simple and compact cushion construction; provides a rugged construction for reliable performance over long-term service.

It is to be understood that the above detailed description of preferred embodiments of the invention are provided by way of example only. Various details of design, construction and procedure may be modified without departing from the true spirit and scope of the invention, as set forth in the appended claims.

The embodiments of the invention in which an exclusive property or privilege is claimed are defined as follows:

1. A cushion for accommodating a posterior profile contour configuration present at the pelvic/genital/rectal region of a person to provide the person with relief of pain or discomfort, the cushion comprising:

a cushion construct having a resilient core for supporting the person while conforming to the posterior profile contour configuration, the cushion construct having a U-shaped plan configuration including a laterally extending rear spine and laterally spaced apart, longitudinally extending legs projecting forward from the laterally extending rear spine to corresponding remote forward terminal ends and establishing a gap between the legs, the gap extending longitudinally along the legs from the laterally extending rear spine to the corresponding remote terminal ends of the legs; and a basal construct affixed to the cushion construct, beneath the cushion construct, the basal construct including a substrate having a plan configuration corresponding to, and contiguous with, at least a portion of the U-shaped plan configuration of the cushion construct, the basal construct further including at least two airways within the substrate, each one of the two airways extending between an air inlet placed at a forward location forward of and spaced longitudinally from a corresponding remote forward terminal end of a corresponding leg, and a corresponding air outlet, the corresponding air outlet being located at an air port juxtaposed with the gap, each airway being arranged for conducting ambient air from a corresponding air inlet to a corresponding air port, and an air mover arrangement placed at the forward location for moving ambient air from the air inlet, through the airways, and out the corresponding air ports into the gap, then through the gap and out of the cushion at an exhaust outlet located between the corresponding remote terminal ends of the legs, and then longitudinally between the forward terminal ends and the forward location to provide an unobstructed exit from the cushion for facilitating a flow of continuously exchanged cooling ambient air through the gap and out of the cushion at the exhaust outlet and directing the flow of continuously exchanged cooling ambient air to the pelvic/genital/rectal region of the person supported on the cushion construct, thereby providing the person with relief of pain or discomfort.

2. The cushion of claim 1 wherein a corresponding air port is located in each leg, in juxtaposition with the gap, and a corresponding airway is arranged for conducting ambient air to each corresponding air port.

3. The cushion of claim 2 wherein;

the gap includes a plenum-like portion adjacent the rear spine;

each air port is juxtaposed with the plenum-like portion of the gap; and the cushion construct includes a surface contour configuration for assisting location of the pelvic/genital/rectal region of the person in register with the plenum-like portion of the gap.

4. The cushion of claim 2 wherein the air mover arrangement includes a single air mover associated with both corresponding air ports.

5. The cushion of claim 1 wherein the cushion construct extends in a horizontal direction at a given level, between the rear spine and the forward terminal ends of the legs, and the airways each include a corresponding tubular construct extending between a corresponding forward terminal end and a corresponding air inlet, each tubular construct being adapted for placement of each air inlet at an air inlet location spaced vertically below the given level.

6. The cushion of claim 5 wherein each tubular construct is bendable for enabling selective displacement of the air inlets between a first location at the given level and the air inlet location spaced vertically below the given level.

7. The cushion of claim 6 wherein the tubular constructs are spaced apart laterally from one another adjacent corresponding forward terminal ends to facilitate, between the tubular constructs, the flow of exhaust air emanating from the exhaust outlet.

8. The cushion of claim 7 wherein the tubular constructs terminate at a common air inlet spaced from and forward of the forward terminal ends of the legs.

9. The cushion of claim 8 wherein the tubular constructs converge from the forward terminal ends of the legs to the common air inlet.

10. The cushion of claim 9 wherein the air mover arrangement includes a single air mover associated with both tubular constructs in juxtaposition with the common air inlet.

11. A method for accommodating a posterior profile contour configuration present at the pelvic/genital/rectal region of a person to provide the person with relief of pain or discomfort, the cushion comprising:

providing a cushion construct having a resilient core for supporting the person while conforming to the posterior profile contour configuration, the cushion construct having a U-shaped plan configuration including a laterally extending rear spine and laterally spaced apart, longitudinally extending legs projecting forward from the laterally extending rear spine to corresponding remote forward terminal ends and establishing a gap between the legs, the gap extending longitudinally along the legs from the laterally extending rear spine to the corresponding remote terminal ends of the legs;

affixing a basal construct to the cushion construct beneath the cushion construct, the basal construct including a substrate having a plan configuration corresponding to, and contiguous with, at least a portion of the U-shaped plan configuration of the cushion construct;

providing at least two airways within the substrate;

extending each one of the two airways between an air inlet placed at a forward location forward of and spaced longitudinally from the forward terminal ends of the legs, and a corresponding air outlet;

locating each corresponding air outlet at an air port juxtaposed with the gap;

arranging each airway for conducting ambient air from a corresponding air inlet to a corresponding air port; and placing an air mover arrangement at the forward location for moving ambient air from the air inlet, through the airways, and out the corresponding air ports into the gap, then through the gap and out of the cushion at an exhaust outlet located between the corresponding remote terminal ends of the legs, and then longitudinally between the forward terminal ends and the forward location to provide an unobstructed exit from the cushion for facilitating a flow of continuously exchanged cooling ambient air through the gap and out of the cushion at the exhaust outlet and directing the flow of continuously exchanged cooling ambient air to the pelvic/genital/rectal region of the person supported on the cushion construct, thereby providing the person with relief of pain or discomfort.

12. The method of claim 11 including locating a corresponding air port in each leg, in juxtaposition with the gap, and arranging a corresponding airway for conducting ambient air to each corresponding air port.

13. The method of claim 12 including providing the gap with a plenum-like portion adjacent the rear spine;

juxtaposing each air port with the plenum-like portion of the gap; and providing the cushion construct with a surface contour configuration for assisting location of the pelvic/genital/rectal region of the person in register with the plenum-like portion of the gap.

14. The method of claim 12 including associating a single air mover with both corresponding air ports.

15. The method of claim 11 including extending the cushion construct in a horizontal direction at a given level, between the rear spine and the forward terminal ends of the legs;

extending a corresponding tubular construct between a corresponding forward terminal end and a corresponding air inlet; and placing each air inlet at an air inlet location spaced vertically below the given level.

16. The method of claim 15 including rendering each tubular construct bendable; and selectively displacing the air inlets between a first location at the given level and the air inlet location spaced vertically below the given level.

17. The method of claim 16 including spacing the tubular constructs apart laterally from one another adjacent corresponding forward terminal ends to facilitate, between the tubular constructs, the flow of exhaust air emanating from the exhaust outlet.

18. The method of claim 17 including terminating the tubular constructs at a common air inlet spaced from and forward of the forward terminal ends of the legs.

19. The method of claim 18 including converging the tubular constructs from the forward terminal ends of the legs to the common air inlet.

20. The method of claim 19 including arranging a single air mover associated with both tubular constructs in juxtaposition with the common air inlet.

* * * * *